United States Patent [19]

McGrath et al.

[11] Patent Number: 4,968,407

[45] Date of Patent: Nov. 6, 1990

[54] SLUDGE DEWATERING AND DESTRUCTION WITHIN A DELAYED COKING PROCESS

[75] Inventors: Michael J. McGrath, Oxford; Rino L. Godino, Livingston, both of N.J.

[73] Assignee: Foster Wheeler USA Corporation, Clinton, N.J.

[21] Appl. No.: 185,617

[22] Filed: Apr. 25, 1988

[51] Int. Cl.[5] ..... C10G 9/14; C10B 43/14

[52] U.S. Cl. ..... 208/131; 208/50; 208/48 Q; 201/25; 202/95

[58] Field of Search ..... 208/131, 48 Q, 50; 201/10, 25; 202/135, 95

[56] References Cited

U.S. PATENT DOCUMENTS

| | | | |
|---|---|---|---|
| 2,550,432 | 4/1951 | Thompson | 201/25 |
| 2,752,290 | 6/1976 | Beattie | 208/131 |
| 3,705,077 | 12/1972 | Franz et al. | 201/25 X |
| 3,855,069 | 12/1974 | Hess et al. | 201/25 X |
| 3,876,538 | 4/1975 | Hess et al. | 210/21 |
| 3,917,564 | 11/1975 | Meyers | 208/131 |
| 4,014,661 | 3/1977 | Hess et al. | 201/25 X |
| 4,118,281 | 10/1978 | Yan | 201/2.5 |
| 4,334,981 | 6/1982 | Holloway et al. | 208/131 |
| 4,547,284 | 10/1985 | Sze et al. | 208/131 X |
| 4,666,585 | 5/1987 | Figgins et al. | 208/131 |

*Primary Examiner*—Glenn Caldarola

*Attorney, Agent, or Firm*—Marvin A. Naigur

[57] ABSTRACT

Wet refinery sludges are disposed of by feeding them into a delayed coking process. The sludge is fed to the blowdown drum of the delayed coking process and mixed with oil condensed from the coke drum overhead, and the resulting sludge-oil mixture is fed to the coke drum where it is converted into coke. In order to remove the water from the sludge, a portion of the sludge-oil mixture is heated and recirculated to the blowdown drum where it provides the heat for drying and heating the sludge. The recirculating sludge-oil mixture is heated by a low level heat source, such as one of the fluid streams taken off from the fractionator.

20 Claims, 1 Drawing Sheet

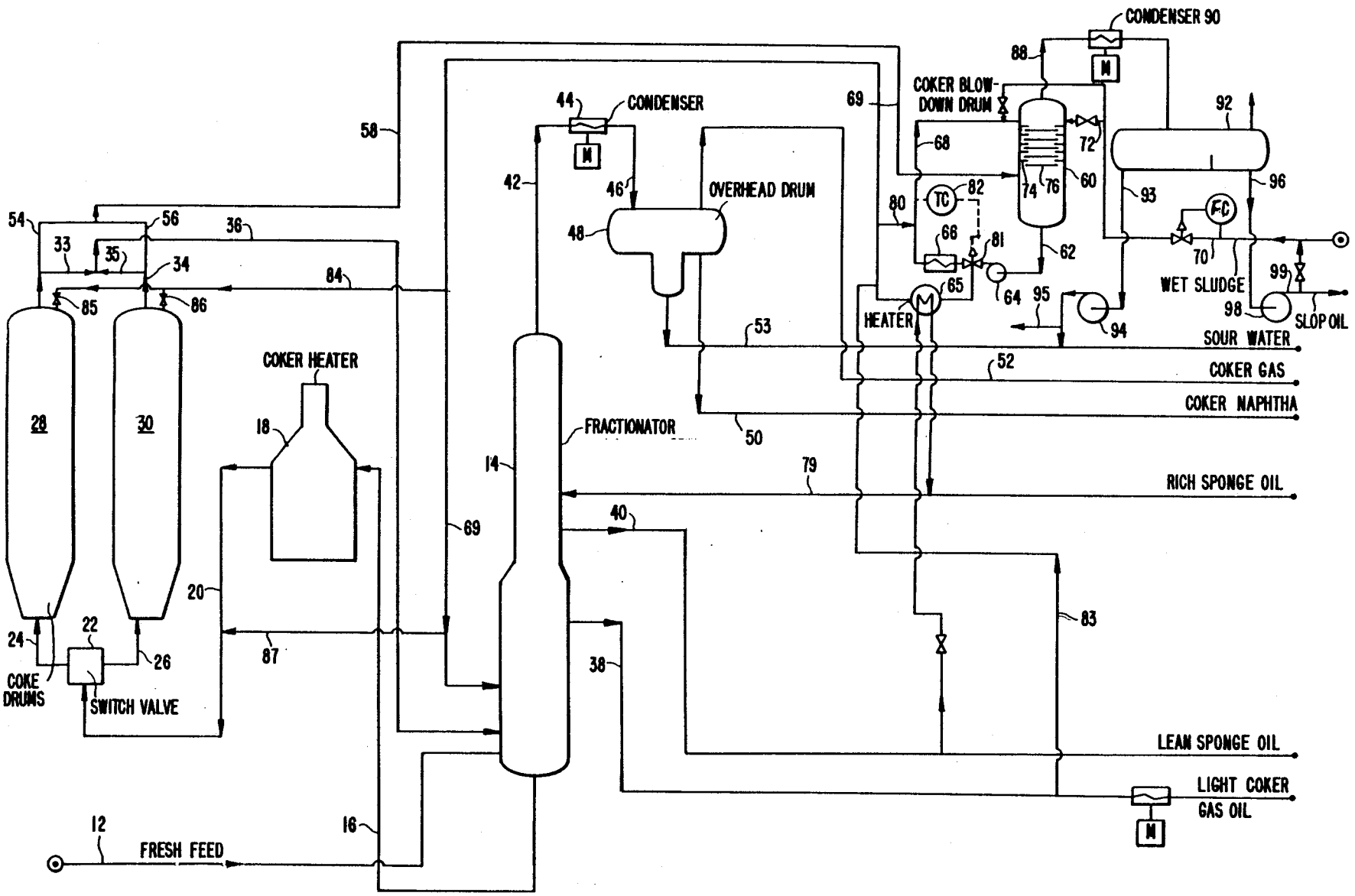
CONDENSER 90
SLOP OIL
WET SLUDGE
SOUR WATER
COKER GAS
COKER NAPHTHA
RICH SPONGE OIL
LEAN SPONGE OIL
LIGHT COKER GAS OIL
COKER BLOW-DOWN DRUM
HEATER
OVERHEAD DRUM
CONDENSER
FRACTIONATOR
COKER HEATER
SWITCH VALVE
COKE DRUMS
FRESH FEED

SLUDGE DEWATERING AND DESTRUCTION WITHIN A DELAYED COKING PROCESS

BACKGROUND OF THE INVENTION

The present invention relates to the disposal of sludge and, more particularly, the disposal of refinery sludges having high water content and solids.

Refinery sludges having high water content and containing solids pose a difficult disposal problem for refiners. Not only must refiners dispose of a mass of material, they must avoid polluting, handle the material safely, and accomplish the disposal economically. Dewatering the sludge can be especially difficult and expensive to accomplish.

Systems are known in which petroleum sludge is disposed of in a delayed coking process. For example, U.S. Pat. No. 4,666,585 to Figgins et al. discloses mixing petroleum sludge with oil to form a slurry and injecting the slurry into a feedline leading to the coke drum. However, that process requires a special slurry drum which is additional to the equipment needed in a conventional delayed coking process. Furthermore, accessory equipment such as an agitator, motor and connections to the delayed coking equipment, and perhaps an additional pump are needed.

SUMMARY OF THE INVENTION

In order to derive the benefits of disposing of wet refinery sludges in a delayed coking process and, at the same time, overcome the disadvantages of the prior art, the process according to the present invention employs, with only minor changes, equipment which is already present in a conventional delayed coking process.

Specifically, the refinery sludge is fed to the existing blowdown drum of the delayed coking process, where it mixes with oil condensed in the blowdown drum from oil vapors stripped from coke in the coke drum, the mixing being brought about as the sludge and the medium fall through the tortuous path defined by the trays in the blowdown drum. Low level heat which would normally be rejected to the atmosphere, cooling water or perhaps to low-pressure steam generation, such as the heat from one of the hot liquid streams taken from the coker fractionator in the conventional delayed coking process, is used to heat the resulting sludge-oil mixture. A small amount of one of these hot fluid streams can be added to the sludge-oil mixture to reduce its viscosity. A portion of the heated sludge-oil mixture is recirculated to the blowdown drum, where it dries and heats the incoming sludge. The water from the mixture is driven off as vapor through the overhead of the blowdown drum from which it is condensed in an existing blowdown condenser and settled in an existing blowdown settling drum, from which it is fed by an existing blowdown water pump to either a sour water disposal line or a decoking water storage tank to be used in cooling and decoking the coke drums. The rest of the sludge-oil mixture is fed into the coke drum with the coke feedstock during the coking operation, where it is converted into coke, thereby solving the sludge disposal problem with a minimal capital expenditure.

BRIEF DESCRIPTION OF THE DRAWINGS

The drawing figure is a schematic flow diagram illustrating a system for carrying out the process according to the present invention.

DETAILED DESCRIPTION OF THE PREFERRED EMBODIMENT

The process for disposing of wet refinery sludge according to the present invention employs, with a few minor alterations, the equipment for a delayed coking operation, which will be described as follows. An inlet line 12 receives fresh feed from a source, such as the residual bottoms from a refining process and directs the feed to a lower portion of a fractionator 14. The bottoms from the fractionator 14 are fed through a line 16 to a coker heater 18 for raising the temperature of the bottoms to a level appropriate for forming coke. The heated bottoms, which comprise the feedstock for forming the coke, are taken from the coker heater 18 through a line 20 and directed by a switch valve 22 through a line 24 or 26 to one of two coke drums 28 or 30. While coke is forming in one of the coke drums, the coke in the other drum is usually undergoing other processes, such as quenching, conditioning or removal. Although two coke drums have been illustrated, the sludge disposal process according to the present invention is suitable for use with delayed coking processes employing any number of coke drums. During the coking process, vapors are taken from the overhead of one of the coke drums 28 or 30 through a line 32 or 34, respectively, and fed through a line 36 to the fractionator 14. Various hot fluid product streams are taken off from the fractionator 14, such as light coker gas oil through a line 38 and lean sponge oil through a line 40. The overhead vapors from the fractionator 14 pass through a line 42, a condenser 44 and a line 46 to a fractionator overhead drum 48 from which coker naphtha and coker gas are taken off through lines 50 and 52, respectively. Sour water is also taken from the fractionator overhead drum 48 through a line 53. Normally, several other product streams are also taken off from the fractionator 14, but they need not be specifically identified here since they are conventional and well-known.

When the formation of coke has been completed in one of the coke drums 28 or 30, steam is injected into the bottom of the drum to quench the coke in the drum. During the quenching, the steam removes oil vapors from the coke in the drum and carries them through the overhead line 32 or 34 and then through respective overhead lines 54 or 56 to a line 58 which directs the steam containing the oil vapors to a coker blowdown drum 60, where the steam is cooled and a portion of the oil is condensed. The condensed oil is taken off at the bottom of the blowdown drum 60 through a line 62 and fed by a pump 64 through a heater 65 or a cooler 66, and a portion of the oil is recirculated through a line 68 back into the blowdown drum 60, while the rest is fed to one of the coke drums 28 and 30 or to the fractionator 14 through a line 69. When a quenching operation is taking place, the recirculated portion of the oil is sent through the cooler 66 in order to remove, in the blowdown drum 60, heat from the steam and oil vapors coming from the coke drum overhead through line 58. At other times, the recirculating portion of the oil is sent through the heater 65 to keep it warm.

It is understood that the apparatus for conventional delayed coking also includes additional elements not specifically described or illustrated in order to simplify the presentation of the present invention. Such elements include but are not limited to valves, pumps, compressors, condensers and controls. In addition, there are many variations in conventional delayed coking processes, some variations involving recirculating different fluid streams to the coke drums or to the fractionator.

In contrast to the foregoing detailed description, which relates to conventional delayed coking, the following concerns the incorporation of a method for disposing of wet refinery sludge in the delayed coking process, using the equipment already required for the delayed coking process. Wet refinery sludge is brought into the delayed coking system through a line 70, which leads to the top of the blowdown drum 60, either directly through a line 72 or by connection with the line 68 for the recirculating blowdown oil, or both. The sludge and the blowdown oil mix in the blowdown drum 60 by falling through a tortuous path defined by trays 74 and 76 in the blowdown drum, thereby forming a sludge-oil mixture and vaporizing water. A portion of the sludge-oil mixture formed by the combining of the oil and sludge is recirculated to the blowdown drum 60 and the remainder is fed to one of the coke drums 28 or 30, or is recirculated to the fractionator 14. During a quenching operation, the recirculated portion of the sludge-oil mixture is cooled so that it can remove heat from the stream and oil vapors entering the blowdown drum 60 via the line 58. At other times, the recirculated portion is directed through the heater 65 where it picks up sensible heat and then acts as a heat source in the blowdown drum 60 to vaporize water in the incoming wet petroleum sludge, thereby heating and drying the sludge. Other heat for the blowdown drum 60 is provided by the vapors flowing from the overhead of the coke drums 28 and 30 through the line 58.

The heat for the blowdown heater 65 is provided by a low level heat source which would normally be rejected to the atmosphere or to cooling water, or used for low-pressure steam generation. Such a heat source is one of the hot fluid product streams taken off from the fractionator 14, such as the lean sponge oil stream, which is taken off through the line 40. A portion of the lean sponge oil is directed through the blowdown heater 65 where it passes in heat transfer relationship with the sludge-oil mixture. Thus, the blowdown heater 65 is a heat exchanger. The cooled lean sponge oil can then be sent back into the fractionator 14 through a convenient line, such as a rich sponge oil line 79. A return line 80 connects the lines 69 and 68, so that the heated sludge-oil mixture can also be returned to the blowdown drum 60.

A valve 81 capable of directing the flow of sludge-oil mixture from the blowdown drum 60 to either the cooler 66 or the blowdown heater 65 is positioned downstream of the pump 64 and is responsive to a temperature sensor 82 placed in the line 68 downstream of its connection with the heated sludge-oil mixture return line 80. Thus, the valve 81 can cause the recirculating sludge-oil mixture to flow through either the cooler 66 or the blowdown heater 65 depending on whether the sludge-oil mixture returning to the blowdown drum is above or below a predetermined level. A diluent is added to the heated sludge-oil mixture to reduce its viscosity and lower the concentration of the solids. Light coker gas oil is suitable for this purpose, and so a line 83 can be provided between the light coker gas oil line 38 and a point just downstream of the blowdown heater 65 in the line 69 which directs the heated sludge-oil mixture to the coke drums.

The sludge-oil mixture from line 82 can be fed directly through a line 84 into the top of one of the coke drums 28 or 30 through a valve 85 or 86, respectively, or through a line 87 into the line 20 transferring heated coker feedstock from the coker heater 18 to either one of the coke drums 28 and 30, or both, as is shown in the drawing figure. In addition, the sludge-oil mixture can be fed into the line 16 on the inlet side of the coker heater 18 or into the coker fractionator 14, either individually or in any combination with the injection points previously mentioned. The actual location of injection depends on the configuration of the delayed coker system and the properties of the sludge.

The water driven off from the sludge-oil mixture in the blowdown drum 60 as steam is directed overhead through a line 88 to a blowdown condenser 90 and then to a blowdown settling drum 92. The water is then taken from one end of the settling drum 92 through a line 93 and fed by a blowdown water pump 94 to either the sour water line 53 or to a line 95 which leads to a decoking water storage tank (not shown). The water in the decoking water storage tank is used to cool and hydraulically decoke the coke drums. Slop oil is recovered from the other end of the settling drum 92 through a line 96 and is pumped away by a pump 98 through a line 99.

Most of the elements for practicing the method according to the present invention are already included in conventional delayed coking systems. Just a few examples are the coker blowdown drum 60, the pump 64, the blowdown condenser 90, and the blowdown settling drum 92.

The invention may be embodied in other specific forms without departing from its spirit or essential characteristics. The present embodiment is, therefore, to be considered in all respects as illustrative and not restrictive, the scope of the invention being indicated by the claims rather than by the foregoing description, and all changes which come within the meaning and range of the equivalents of the claims are therefore intended to be embraced therein.

We claim:

1. A method for disposing of refinery sludge in a delayed coking process employing a coker heater, at least one coke drum in which coke is formed, a fractionator and a blowdown drum, in which oil vapors from coke formed in the coke drum are sent to the blowdown drum where the oil vapors condense into oil, comprising:

feeding the sludge to the blowdown drum, where the sludge mixes with the oil to form a sludge-oil mixture; and feeding the sludge-oil mixture to the coke drum during the formation of coke, whereby the sludge in the sludge-oil mixture is incorporated in the formed coke.

2. The method according to claim 1, wherein the blowdown drum includes a plurality of trays, and the step of feeding the sludge comprises feeding the sludge to the blowdown drum above the trays.

3. The method according to claim 1, wherein the refinery sludge is wet and the sludge-oil mixture contains water, the method further comprising, after feeding the sludge, removing the water from the sludge by heating the sludge to vaporize the water.

4. The method according to claim 3, wherein the water is removed from the sludge in the blowdown drum.

5. The method according to claim 4, wherein the delayed coking process further employs a condenser, a settling drum and a sour water line connected in series to the overhead of the blowdown drum, and the vaporized water is directed through the overhead, the condenser and the settling drum to the sour water line.

6. The method according to claim 4, wherein the sludge is heated in the blowdown drum.

7. The method according to claim 3, wherein the delayed coking process includes taking off at least one hot fluid product stream from the fractionator, and heat for heating the sludge is provided by the fluid product stream.

8. The method according to claim 6, wherein a portion of the sludge-oil mixture is heated and recirculated to the blowdown drum, and the heat for heating the sludge is provided by the sludge-oil mixture.

9. The method according to claim 8, wherein the delayed coking process includes taking off at least one hot fluid product stream from the fractionator, and the sludge-oil mixture is heated by passing at least a portion of the hot fluid product stream in heat transfer relationship with the sludge-oil mixture.

10. The method according to claim 9, wherein the hot fluid product stream is lean sponge oil, and the sludge-oil mixture is heated by passing at least a portion of the lean sponge oil in heat transfer relationship with the sludge-oil mixture.

11. The method according to claim 1, further comprising adding a diluent to the sludge-oil mixture.

12. The method according to claim 11, wherein the delayed coking process includes taking off at least one hot fluid product stream from the fractionator, and the step of adding a diluent comprises adding a portion of the fluid product stream to the sludge-oil mixture.

13. The method according to claim 12, wherein the hot fluid product stream is light coker gas oil, and the step of adding a diluent comprises adding a portion of the light coker gas oil to the sludge-oil mixture.

14. A combined delayed coking and refinery sludge disposal system comprising:

at least one coke drum;

a blowdown drum in fluid communication with said coke drum to receive oil removed from coke in said coke drum;

means for conducting wet refinery sludge to said blowdown drum;

means for mixing the oil and the sludge in said blowdown drum to form a mixture;

means for conducting the mixture to said coke drum; and means for drying the sludge in said blowdown drum.

15. The system of claim 14, wherein said drying means comprises means for heating the sludge to drive off water vapor.

16. The system of claim 14, wherein said drying means comprises means for recirculating a portion of the mixture to said blowdown drum, and means for heating the portion of the mixture.

17. The system of claim 16, further comprising a fractionator for producing hot fluid products, and said heating means comprises a heat exchanger mounted in said recirculating means and means for passing one of the hot fluid products through said heat exchanger in heat exchange relationship with the mixture of sludge and oil.

18. The system of claim 15, further comprising a sour water line for removing sour water from said system and means for directing the water from the water vapor to the sour water line.

19. A combined delayed coking and refinery sludge disposal system comprising:

at least one coke drum;

a blowdown drum in fluid communication with said coke drum to receive oil removed from coke in said coke drum;

means for conducting wet refinery sludge to said blowdown drum;

means for mixing the oil and the sludge in said blowdown drum to form a mixture;

means for conducting the mixture to said coke drum; and means for diluting the mixture.

20. The system of claim 19, further comprising a fractionator for producing hot fluid products, and said diluting means comprises means for conveying one of said hot fluid products to said means for conducting the mixture to the coke drum.

* * * * *